US008726769B1

(12) United States Patent
Jacker

(10) Patent No.: US 8,726,769 B1
(45) Date of Patent: May 20, 2014

(54) UNIVERSAL SCREW HOLDER FOR SCREWDRIVERS

(76) Inventor: Michael Howard Jacker, Highland Park, IL (US)

( * ) Notice: Subject to any disclaimer, the term of this patent is extended or adjusted under 35 U.S.C. 154(b) by 262 days.

(21) Appl. No.: 13/468,025

(22) Filed: May 9, 2012

(51) Int. Cl.
*B25B 23/08* (2006.01)
*B25B 23/10* (2006.01)

(52) U.S. Cl.
CPC ..... *B25B 23/101* (2013.01)
USPC ..... 81/451; 81/458

(58) Field of Classification Search
CPC .... B25B 23/101; B25B 23/005; B25B 23/00; B25B 23/08
USPC ..... 81/451, 452, 456, 458
See application file for complete search history.

(56) References Cited

U.S. PATENT DOCUMENTS

| | | | | | |
|---|---|---|---|---|---|
| 797,078 | A * | 8/1905 | Shelton | 81/456 |
| 3,633,640 | A * | 1/1972 | Moore | 81/451 |
| 4,063,580 | A * | 12/1977 | Bischoff, Jr. | 81/451 |
| 4,526,072 | A * | 7/1985 | Manhoff, Jr. | 81/451 |
| 5,029,498 | A * | 7/1991 | Kinsey | 81/451 |
| 5,065,649 | A * | 11/1991 | Evers et al. | 81/458 |
| 6,116,125 | A * | 9/2000 | McLeod | 81/456 |
| 6,138,538 | A * | 10/2000 | Neijndorff | 81/451 |
| 7,757,590 | B2 * | 7/2010 | Swartz | 81/451 |
| 2007/0295172 | A1 * | 12/2007 | Swartz | 81/451 |

* cited by examiner

*Primary Examiner* — David B Thomas

(57) ABSTRACT

The present invention provides a device made of a single piece of elastic material to be used to secure a fastener to a driving tool (such as a screwdriver) to facilitate insertion or extraction of the fastener. A characteristic of the invention is that a single device is applicable to a wide variety of fastener materials, configurations, and sizes, as well as a wide variety of insertion tool configurations and sizes. The device has two open ends with generally cylindrical or conical inner wall shape, including inner wall appendages and contours configured for gripping a driving tool of various sizes while gripping a fastener of various sizes in line with the driving tool. The device permits visibility of the fastener, automatic release of the fastener, and may be stored upon the driving tool.

6 Claims, 2 Drawing Sheets

UNIVERSAL SCREW HOLDER FOR SCREWDRIVERS

CROSS-REFERENCE TO RELATED APPLICATIONS

Not Applicable

STATEMENT REGARDING SPONSORED FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

1. Field of Endeavor to Which the Invention Pertains

The present invention is related to hand tools and power tools used for the insertion or extraction of fasteners, particularly screws and bolts, into any substrate.

2. Subject Matter of the Invention

More particularly, the present invention is related to devices for temporarily securing a fastener of a variety of sizes and configurations to the working tip of a driving tool of a variety of sizes and configurations to facilitate one-handed insertion or extraction of the fastener.

PRIOR ART

U.S. Patent Numbers:

U.S. Pat. No. 768,441 Fisher Aug. 23, 1904
U.S. Pat. No. 797,078 Shelton Aug. 15, 1905
U.S. Pat. No. 1,360,500 Coll Nov. 30, 1920
U.S. Pat. No. 2,723,694 Ross Nov. 15, 1955
U.S. Pat. No. 2,954,809 Loewy Oct. 4, 1960
U.S. Pat. No. 3,245,446 Morifuji Apr. 12, 1966
U.S. Pat. No. 3,517,714 Desbarats Jun. 30, 1970
U.S. Pat. No. 4,221,249 Mazzeo, et. al Sep. 8, 1980
U.S. Pat. No. 4,526,072 Manhoff, Jr. Jul. 2, 1985
U.S. Pat. No. 4,581,963 Kim Apr. 15, 1986
U.S. Pat. No. 4,719,828 Corsetti Jan. 19, 1988
U.S. Pat. No. 4,979,354 Johnson Dec. 25, 1990
U.S. Pat. No. 5,065,649 Evers, et. al Nov. 19, 1991
U.S. Pat. No. 5,129,292 Albert Jul. 14, 1992
U.S. Pat. No. 6,116,125 McLoed Sep. 12, 2000

Problems Involved in the Prior Art

While there have been various screw holders in the prior art, the present invention contains numerous advantages. In addition to being efficient and economical, embodiments of the present invention utilize a single molded part, which can accommodate various sizes, shapes, and head types of screws or other fasteners being held, and can accommodate various sizes and shapes of screw drivers or other fastener insertion devices. Additionally, embodiments of the present invention fulfill all of the desirable characteristics of a providing a secure grip of a fastener, maintaining the fastener in line with the axis of the insertion tool, permitting visibility of the fastener during use, permitting use for either insertion or extraction of a fastener, releasing a fastener upon insertion, not marring or scratching an insertion substrate, being storable upon the shaft of a driving tool when not in use, and not requiring training to operate.

BRIEF SUMMARY OF THE INVENTION

The present invention provides a device made of a single piece of elastic material to be used to secure a fastener to a driving tool (such as a screwdriver) to facilitate insertion or extraction of the fastener. In a preferred embodiment of the invention, a single device is applicable to a wide variety of fastener materials, configurations, and sizes, as well as a wide variety of driving tool configurations and sizes. In order to address problems with the prior art, it is an object of the present invention to provide a device that is simple and economical to manufacture and is made from a single piece of material. It is a further object of the present invention to provide a device that provides a secure grip of a fastener, maintains the fastener in line with the axis of the driving tool, permits visibility of the fastener during use, is applicable for either insertion or extraction of a fastener, releases a fastener upon insertion, does not mar or scratch an insertion substrate, can be stored upon the shaft of a driving tool when not in use, and does not require training to operate.

BRIEF DESCRIPTION OF THE SEVERAL VIEWS OF THE DRAWING

Two embodiments of the invention will be described by way of example only and with reference to the accompanying drawings, in which.

DETAILED DESCRIPTION OF THE INVENTION

Description

Figure 1:
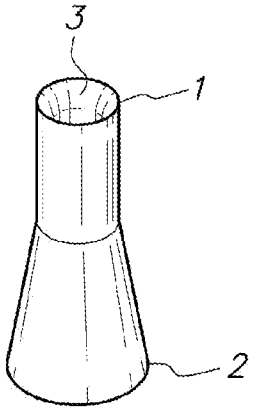
FIG. 1 is an overall view of the first embodiment of the described device.
Figure 2:
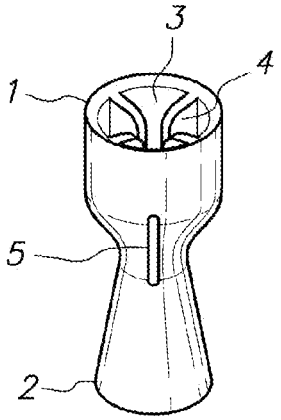
FIG. 2 is an overall view of the second embodiment of the described device.
Figure 3:
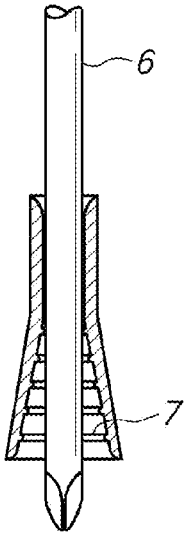
FIG. 3 is a sectional view of the first embodiment shown in conjunction with a screwdriver.
Figure 4:
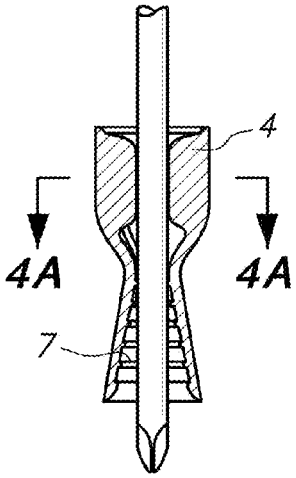
FIG. 4 is a sectional view of the second embodiment shown in conjunction with a narrow screwdriver shaft.
Figure 5:
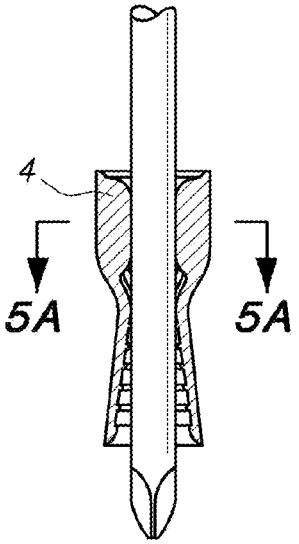
FIG. 5 is a sectional view of the second embodiment shown in conjunction with a wide screwdriver shaft.
Figure 4A:
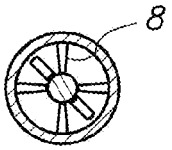
FIG. 4A is an axial view of the second embodiment shown in conjunction with a narrow screwdriver shaft.
Figure 5A:
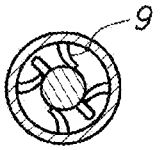
FIG. 5A is an axial view of the second embodiment shown in conjunction with a wide screwdriver shaft.

The preferred embodiment of the present invention (FIGS. 1 and 2), is a device constructed of a single piece of molded rubber, plastic, or other elastic material, which may be transparent or opaque, possessing no separate moving parts.

The outside preferably is contoured or has a textured surface to facilitate manual gripping of the device.

The device includes a hollow and generally cylindrical barrel (3) with a deformable elastic wall (1) either with or without internal flexible fins or leaflets oriented either transversely or longitudinally (4, 8, & 9), designed to assist in creating friction to prevent spontaneous sliding along the shaft of the driver (6), and designed to securely accommodate a variety of driver shaft shapes and dimensions. The barrel, (3) extends from a first end (1) of the device through a second end (2) of the device.

Two channels along the length of this barrel (5) may or may not be included to accommodate the passage of the broad tip of a slotted screwdriver.

The portion of the barrel nearer the second end (2) of the device is generally conical in shape with an opening contiguous with second end (2) of the barrel. The wider end of the conical portion is located at the second end (2) and the narrower end of the conical opening is located closer to the first end (1) of the device.

The inner wall of the conical lower portion of the device is lined circumferentially with several horizontal annular ribs, or recesses (7) spaced to permit secure circumferential grip and longitudinal stabilization of a fastener head of a variety of diameters.

The fastener (10) is secured in the device by means of friction, by the pressure produced by the elastic properties of the device wall, and by engagement of the fastener's head immediately above one of the annular ribs (11) or within one of the annular recesses. These ribs or recesses secure the fastener in line with the longitudinal axis of the driver.

The lower end of the device is of a wall thickness, hardness, and elasticity to permit the lower end to be everted (folded back) upon itself (12), thereby presenting the entire fastener shaft outside of the device.

Applications of the Device:

Possible applications include: Attaching an object to a wall while manually supporting the object or yourself, such as on a ladder; inserting a fastener through a confined opening; or working in areas where a dropped fastener may be irretrievable;

It is designed to be utilized interchangeably with a wide range of screwdriver sizes, hex key wrenches, and other insertion, extraction, or driving tools of any cross-sectional shape.

It is designed to fit a wide variety of fastener head shapes, including, but not limited to round, pan, oval, and hex.

It is interchangeable between fasteners of many screw head types, including, but not limited to slotted, Phillips, hex, cruciate, star, or other screw or bolt types.

It is designed to fit a wide range of metric, English, or unconventionally sized fasteners.

It is designed to be used with fasteners and driving tools of many materials including, but not limited to ferrous metals, non-ferrous metals, plastics, ceramics, carbon fiber, or composite materials.

It is designed to manually slide onto, as well as along the length of the shaft of the driving tool.

It can be withdrawn from the driving tip toward the handle of the driver along the driver's shaft for storage when not in use, permitting the driver to be used conventionally without removal of the device.

It may be utilized with either a manual or powered driving tool.

It may be used either for insertion or extraction of a fastener.

It is manufactured of soft material to avoid marring or damaging objects or insertion substrate surfaces.

Eversion of the lower end facilitates use of a single device with a fastener of various lengths, having either a small or large head diameter, while always presenting the screw shaft outside of the lower end of the device.

Figure 6:
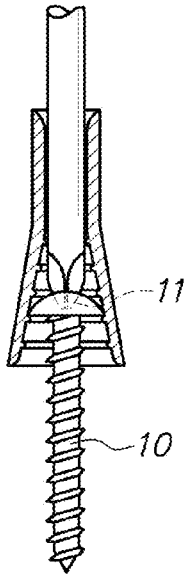
FIG. 6 is a sectional view of the first embodiment shown in conjunction with a screwdriver and a screw of large head diameter.
Figure 7:
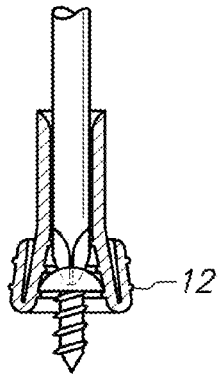
FIG. 7 is a sectional view of the first embodiment shown in conjunction with a screwdriver and a screw of small head diameter.
Figure 8:
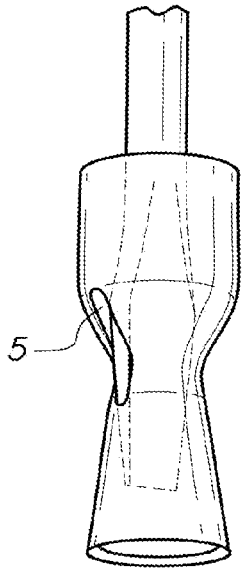
FIG. 8 is an overall view of the second embodiment illustrating the channels to accommodate passage of the wide portion of the blade of a slotted screwdriver.
Figure 9A:
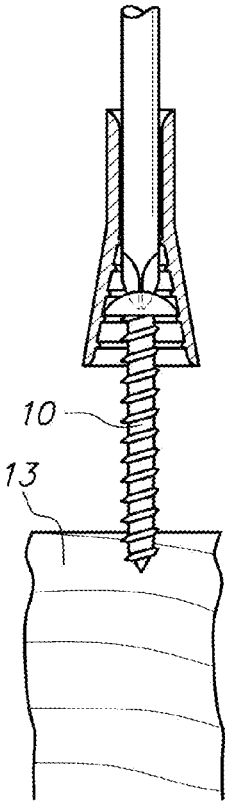
FIGS. 9A, 9B, and 9C illustrate the sequence of insertion (or viewed in reverse, the sequence of extraction) of a screw, as well as the automatic release of the screw during insertion.
Figure 9B:
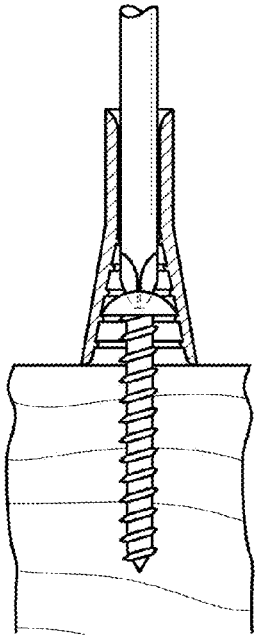
Figure 9C:
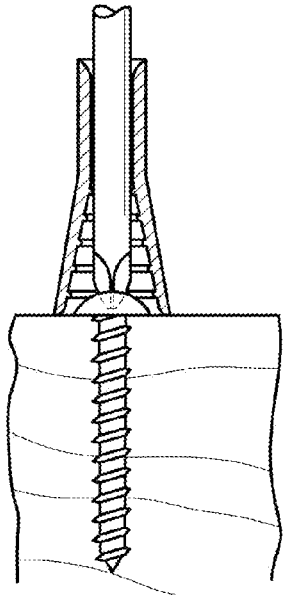

Function of the Device:

The upper end of the barrel (1) is slipped over the tip of the driver and up its shaft (FIGS. 3-9). For fastener insertion, the fastener is initially engaged manually onto the working tip of the driver in a conventional manner (FIGS. 6-9). (E.g. the slotted screw head is engaged with the slotted screwdriver tip.) The device is then slid down the shaft of the driver beyond the tip of the driver, until the fastener is gripped by the device without being held manually (FIGS. 6, 7, & 9A). The lower end of the device may be folded back (evened) upon itself if desired in order to fully expose the fastener shaft (FIG. 7). The fastener is then driven until seated into the substrate (FIGS. 9A, 9B, & 9C). As the device contacts the surface of the object (13) into which the fastener is inserted, it will automatically disengage and retract upon the driver shaft (FIGS. 9B & 9C). For fastener withdrawal, after the fastener is partially withdrawn conventionally, the device is slid down the shaft of the driver beyond the tip of the driver and engaged upon the head of the fastener. The fastener may then be fully withdrawn while secured to the driver by the device (9C→9B→9A). For storage, the device may either be slid up the driver shaft toward its handle or removed completely from the driver.

What I claimed is:

1. A holding device for retaining a fastener to the working end of a driving tool, the device comprising:

a) an elongated body consisting of a single piece of flexible material;

b) said body having a longitudinal axis, and a first end and a second end at opposite ends of said longitudinal axis;

c) said elongated body including a hollow generally cylindrical barrel along said longitudinal axis with an upper portion contiguous with the first end of said barrel and a lower portion contiguous with the second end of said barrel;

d) said barrel having an inner wall at the upper portion of said barrel of a generally cylindrical shape, wherein said barrel can receive and engage the shaft of a driving tool of various sizes;

e) said barrel having a lower portion including a conical inner wall contiguous with and co-axial with the upper portion, with the wider portion of said conical inner wall at the second end of said barrel and a narrower portion toward the first end of said barrel, wherein said wider conical portion can receive the head of a fastener of various sizes;

f) said conical inner wall is lined circumferentially with a plurality of spaced apart horizontal annular ribs or recesses, permitting a secure grip of various sized fasteners.

2. A holding device as in claim 1, possessing a wall thickness, hardness, and elasticity, wherein the lower end is permitted to be everted (folded back) upon itself, thereby presenting the fastener shaft outside of the device.

3. A holding device as in claim 1, including two channels along a portion of its length, wherein said channels accommodate the passage of the wide blade of a driving tool.

4. A holding device as in claim 1, including along the inner wall of the generally cylindrical upper portion of said device three or more flexible fins or leaflets aligned parallel to said device's longitudinal axis, wherein said fins or leaflets enhance said device's stability along the shaft of a driving tool and wherein said flexible fins or leaflets are permitted to fold toward the inner wall of the upper portion of the device in order to accommodate a driving tool shaft of various sizes.

5. A holding device as in claim 1, including along the inner wall of the generally cylindrical upper portion of said device three or more flexible fins or leaflets aligned perpendicular to said device's longitudinal axis, wherein said fins or leaflets enhance said device's stability along the shaft of a driving tool and wherein said flexible fins or leaflets are permitted to fold toward the inner wall of the upper portion of the device in order to accommodate a driving tool shaft of various sizes.

6. A holding device as in claim 1, made of clear silicone rubber, wherein the fastener can be visualized through the device's transparent wall.

* * * * *